US007761943B2

(12) United States Patent
Roleder et al.

(10) Patent No.: US 7,761,943 B2
(45) Date of Patent: Jul. 27, 2010

(54) HEADREST ASSEMBLY FOR A MASSAGE DEVICE

(75) Inventors: Jonathan W. Roleder, San Diego, CA (US); William W. Chow, Del Mar, CA (US); Richard V. Estrada, Oceanside, CA (US)

(73) Assignee: Earthlite Massage Tables, Inc., Vista, CA (US)

( * ) Notice: Subject to any disclaimer, the term of this patent is extended or adjusted under 35 U.S.C. 154(b) by 0 days.

(21) Appl. No.: 12/237,031

(22) Filed: Sep. 24, 2008

(65) Prior Publication Data

US 2009/0077749 A1 Mar. 26, 2009

Related U.S. Application Data

(60) Provisional application No. 60/975,448, filed on Sep. 26, 2007.

(51) Int. Cl.
*A61G 13/12* (2006.01)
*A47G 9/00* (2006.01)

(52) U.S. Cl. ..... 5/622; 5/638; 5/637

(58) Field of Classification Search ..... 5/622, 5/638, 637, 639, 640, 643; 601/15; 297/408, 297/397, 405

See application file for complete search history.

(56) References Cited

U.S. PATENT DOCUMENTS 6,594,839 B1 * 7/2003 Papay ..... 5/637
7,225,485 B2 6/2007 Binder
2006/0288487 A1 12/2006 Roleder et al.

OTHER PUBLICATIONS

International Search Report and Written Opinion for PCT/US08/77553 (related to the present application), publication date Dec. 4, 2008 Earthlite Massage Tables, Inc.

Apr. 8, 2010 Advance E-mail PCT Notification Concerning Transmittal of Preliminary Report on Patentability, along with Preliminary Report on Patentability issued Mar. 30, 2010 and Written Opinion (previously submitted) for PCT/US08/77553 (related to the present application), Earthlite Massage Tables, Inc.

* cited by examiner

*Primary Examiner*—Robert G Santos
*Assistant Examiner*—Brittany M. Wilson
(74) *Attorney, Agent, or Firm*—Roeder & Broder LLP

(57) ABSTRACT

A headrest assembly for supporting a head of a user of a massage device includes a frame assembly and a resilient assembly. The frame assembly is selectively coupled to the massage device, and the resilient assembly is coupled to the frame assembly. The resilient assembly includes an upper resilient member and a headrest platform that supports the upper resilient member. The headrest platform includes a first side section, a second side section, a middle section that is positioned substantially between and is coupled to the first side section and the second side section, and a hinge assembly that connects the side sections to the frame assembly. The hinge assembly allows the middle section to flex substantially downward and the side sections to pivot relative to the hinge assembly when the headrest platform is supporting the head of the user.

32 Claims, 11 Drawing Sheets

HEADREST ASSEMBLY FOR A MASSAGE DEVICE

RELATED APPLICATION

This application claims priority on U.S. Provisional Application Ser. No. 60/975,448 filed on Sep. 26, 2007 and entitled "HEADREST ASSEMBLY FOR A MASSAGE DEVICE". As far as is permitted, the contents of U.S. Provisional Application Ser. No. 60/975,448 are incorporated herein by reference. Additionally, the contents of U.S. patent application Ser. No. 11/452,728 filed on Jun. 13, 2006 are incorporated herein by reference.

BACKGROUND

As the benefits of therapeutic massage are becoming more widely appreciated, more and more people are participating in therapeutic massage. A typical massage table allows the patient to be resting while receiving a massage. A typical massage chair allows the patient to be sitting while receiving a massage. Both types of massage devices include a headrest that supports the head of the patient during a massage. Important features for massage devices include high strength, ease of use, adjustability, light weight, and comfort.

SUMMARY

The present invention is directed to a headrest assembly for supporting a head of a user of a massage device. The headrest assembly includes a frame assembly and a resilient assembly. The frame assembly is selectively coupled to the massage device. The resilient assembly is coupled to the frame assembly. The resilient assembly includes an upper resilient member and a headrest platform that supports the upper resilient member.

As an overview, in certain embodiments, the headrest assembly provides improved comfort, adjustability, and support to a face or head of the user. Moreover, the headrest assembly can have a relatively low profile and can curve to better "wrap", "envelope" and/or "cradle" the face.

In certain embodiments, the headrest platform includes a first side section, a second side section, a middle section that is positioned substantially between and is coupled to the first side section and the second side section, and a hinge assembly that connects the side sections to the frame assembly. The hinge assembly allows the middle section to flex substantially downward and the side sections to pivot relative to the hinge assembly when the headrest platform is supporting the head of the user.

In one embodiment, the hinge assembly includes a first front pivot positioned within the first side section and a second front pivot positioned within the second side section. Each front pivot can include a front pivot hole and a vertical bolt. The front pivot hole is sized to allow the vertical bolt to rotate and to move laterally within the front pivot hole. The hinge assembly also includes a first side pivot that is positioned within the first side section and a second side pivot that is positioned within the second side section.

In some embodiments, the frame assembly includes a support frame having a headrest support section and a flex stop section. The headrest support section is coupled to and supports the resilient assembly. The flex stop section limits how far the middle section can flex downward when downward pressure is applied on the middle section.

The frame assembly can also include a support arm assembly having a first support arm and a spaced apart second support arm that cooperate to selectively couple the headrest assembly to the massage device. Each support arm includes a first end and a second end. The first end of each support arm extends through a headrest receiver on the massage device. Each support arm is somewhat curved so that the first end contacts a support board of the massage device when the support arms are coupled to the massage device.

The present invention is also directed to a massage device assembly including a massage device that supports a body of the user during a massage treatment, and a headrest assembly that supports the head of the user during the massage treatment. The headrest assembly can be selectively coupled to the massage device.

The present invention is further directed to a method of supporting a head of a user of a massage device.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
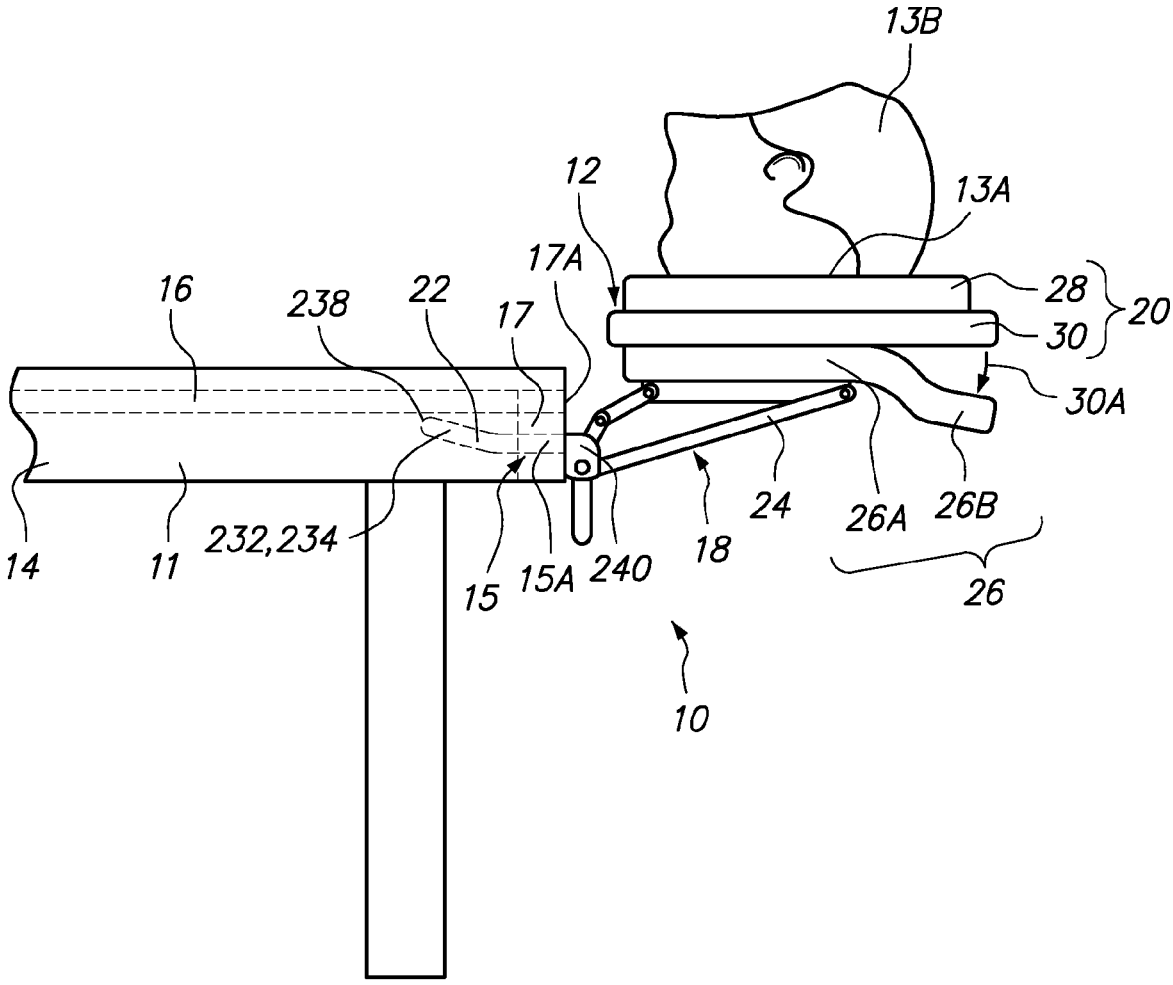
FIG. 1 is a simplified side view of a portion of first embodiment of a massage device assembly having features of the present invention.

FIG. 1 is a simplified, side view of a portion of a massage device assembly 10 having features of the present invention. As illustrated, the massage device assembly 10 includes a massage device 11 that supports a body of a user of the massage device assembly 10, and a headrest assembly 12 that supports a face 13A and/or a head 13B of the user of the massage device assembly 10. The design of the massage device assembly 10 can be varied to suit the needs of the user.

As an overview, in certain embodiments, the headrest assembly 12 provides improved comfort and support to the face 13A and/or the head 13B of a person using the massage device assembly 10. Further, the headrest assembly 12 provides improved adjustability to the user of the massage device assembly 10.

Additionally or alternatively, the headrest assembly 12 can be lighter in weight and/or have a smaller form factor than comparable prior art headrest assemblies (not shown). Further, as provided herein, in certain embodiments, the headrest assembly 12 includes suspension that can better respond to the individual weight and shape of the head 13B and can curve to better "wrap", "envelope" and/or "cradle" the face 13A. Moreover, the headrest assembly 12 can have a relatively low profile.

In FIG. 1, the massage device 11 is a portable, folding massage table that includes a table base 14 that supports the body of the user, and a headrest receiver assembly 15 (illustrated in phantom) that can be used to selectively secure the headrest assembly 12 to the massage device 11. One embodiment of a massage table is disclosed U.S. Pat. No. 5,009,170, issued to Spehar, the contents of which are incorporated herein by reference. Alternatively, for example, the massage device assembly 10 can include another type of massage device, such as a massage chair. One embodiment of a massage chair is disclosed U.S. Pat. No. 6,729,690, issued to Roleder et al., the contents of which are incorporated herein by reference.

In the embodiment illustrated in FIG. 1, the table base 14 includes a support board 16 (illustrated in phantom) that supports the body of the user, a front wall 17 (illustrated in phantom) that cantilevers downward away from the support board 16 near an end of the support board 16, and the headrest receiver assembly 15. The support board 16 is generally flat and rectangular shaped and can be made of a light yet sturdy material such as plywood. Alternatively, the support board 16 can be designed to have a different shape or to be made from a different material.

In FIG. 1, the headrest receiver assembly 15 includes a first headrest receiver (not shown) and a spaced apart second headrest receiver 15A that are secured to the front wall 17 of the massage device 11. In this embodiment, each of the headrest receivers 15A is a generally straight, right cylindrical shaped aperture that extends through the front wall 17 of the massage device 11. Alternatively, the headrest receiver assembly 15 can have another design or can be positioned at another location on the massage device 11.

In FIG. 1, the headrest assembly 12 is removable and adjustably extends and cantilevers away from the front wall 17 of the table base 14. Alternatively, the headrest assembly 12 can be positioned at another location. For example, for a massage chair, the headrest assembly 12 would extend generally upward at an angle from the massage device 11.

FIG. 1 illustrates that the headrest assembly 12 includes a frame assembly 18 and a resilient assembly 20. The size, shape and design of each of these assemblies 18, 20 can be varied to achieve the desired design characteristics of the headrest assembly 12. Further, the resilient assembly 20 defines an opening for receiving a portion of the face 13A or the head 13B of the user. In one embodiment, the resilient assembly 20 is contoured so that one size fits all faces.

In one embodiment, the frame assembly 18 includes a support arm assembly 22, an adjuster assembly 24 that is coupled to the support arm assembly 22, and a support frame 26 that is coupled to the adjuster assembly 24. The support arm assembly 22 is designed to selectively couple the other elements of the headrest assembly 12 to the massage device 11. The adjuster assembly selectively adjusts the positioning of the resilient assembly 20 relative to the massage device 11. The support frame 26 is coupled to and supports the resilient assembly 20.

In certain embodiments, the resilient assembly 20 includes an upper resilient member 28 (e.g. a foam pad) and a flexible headrest platform 30 that supports the upper resilient member 28. During use of the massage device assembly 10, the face 13A and/or the head 13B of the user rests comfortably on the upper resilient member 28. The headrest platform 30 is coupled to and is supported by the support frame 26 of the frame assembly 18.

FIGS. 2A-2D illustrate perspective views of an embodiment of a headrest assembly 212 having features of the present invention. In this embodiment, the headrest assembly 212 includes a frame assembly 218 and a resilient assembly 220. The upper resilient member 28 (illustrated in FIG. 1) is not shown in FIGS. 2A-2D for purposes of clarity.

As noted above, in certain embodiments, the headrest assembly 212 provides improved comfort, support and adjustability to the user of the massage device assembly 10. Additionally or alternatively, the headrest assembly 212 can be lighter in weight and/or have a smaller form factor than comparable prior art headrest assemblies (not shown). Further, in certain embodiments, the headrest assembly 212 includes suspension that can better respond to the individual weight and shape of the head 13B (illustrated in FIG. 1) and can curve to better "wrap", "envelope" and/or "cradle" different sized faces 13A (illustrated in FIG. 1). Moreover, the headrest assembly 212 can have a relatively low profile.

As illustrated in FIGS. 2A-2D, the frame assembly 218 includes a support arm assembly 222, an adjuster assembly 224, and a support frame 226. In one embodiment, the support arm assembly 222 includes a first support arm 232, a spaced apart second support arm 234 that is somewhat parallel to the first support arm 232, and an arm connector 236 that couples the support arms 232, 234 together. Alternatively, the support arm assembly 222 could be designed with more than two or less than two support arms 232, 234.

Figure 2A:
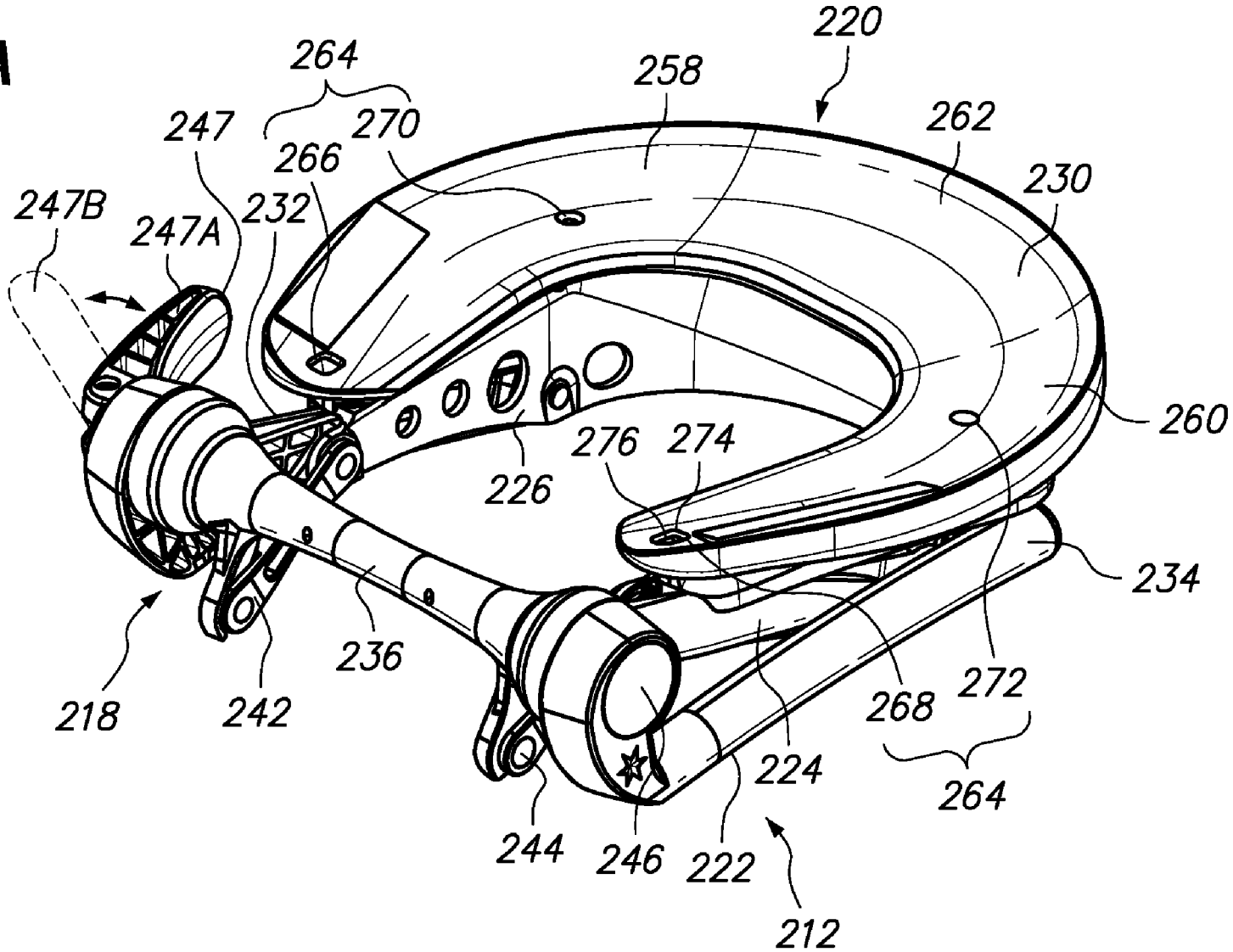
FIG. 2A is a perspective view of a headrest assembly having features of the present invention, with the headrest assembly in a folded configuration.
Figure 2B:
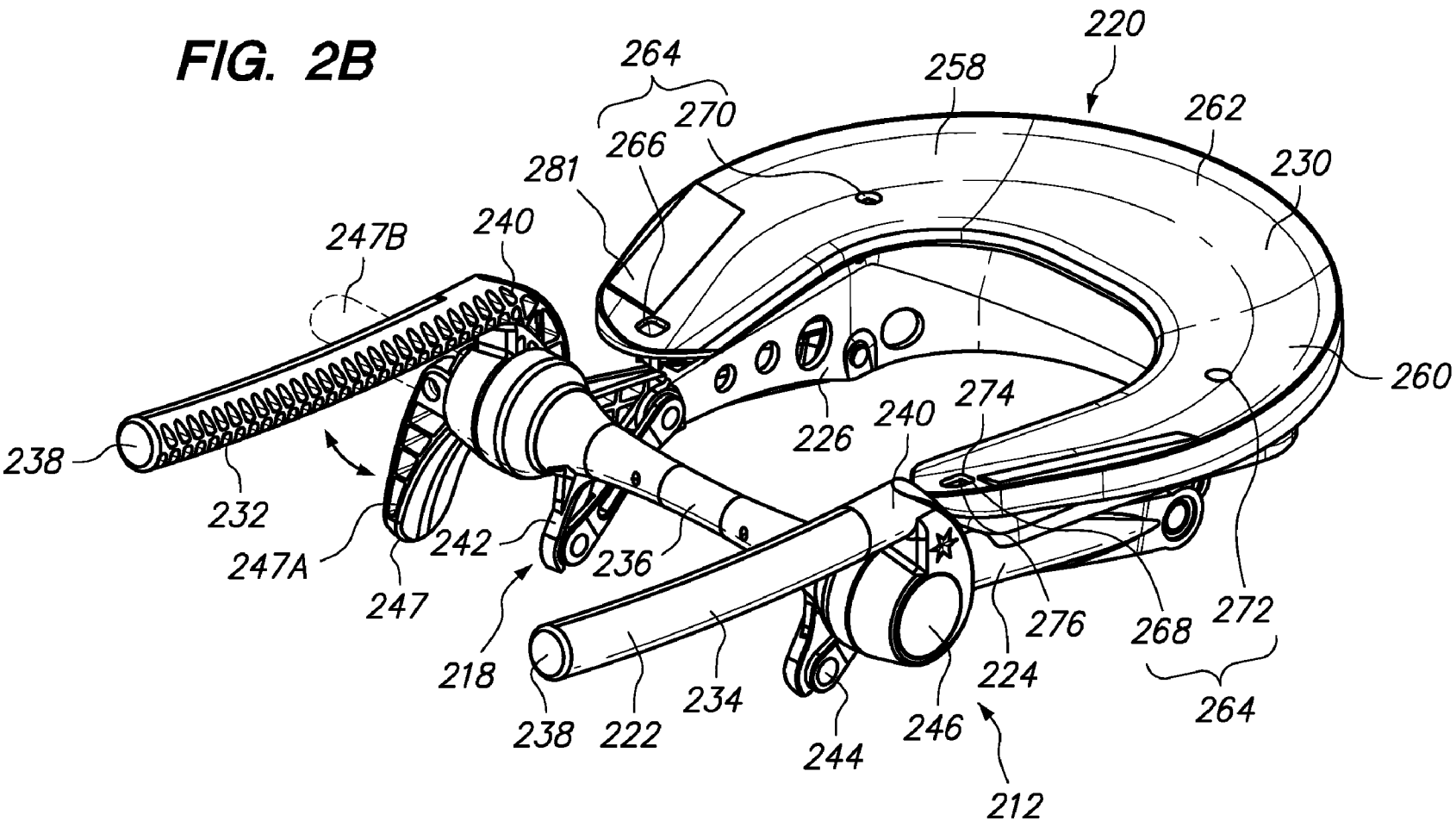
FIG. 2B is another perspective view of the headrest assembly of FIG. 2A with the headrest assembly in a lower position.
Figure 2C:
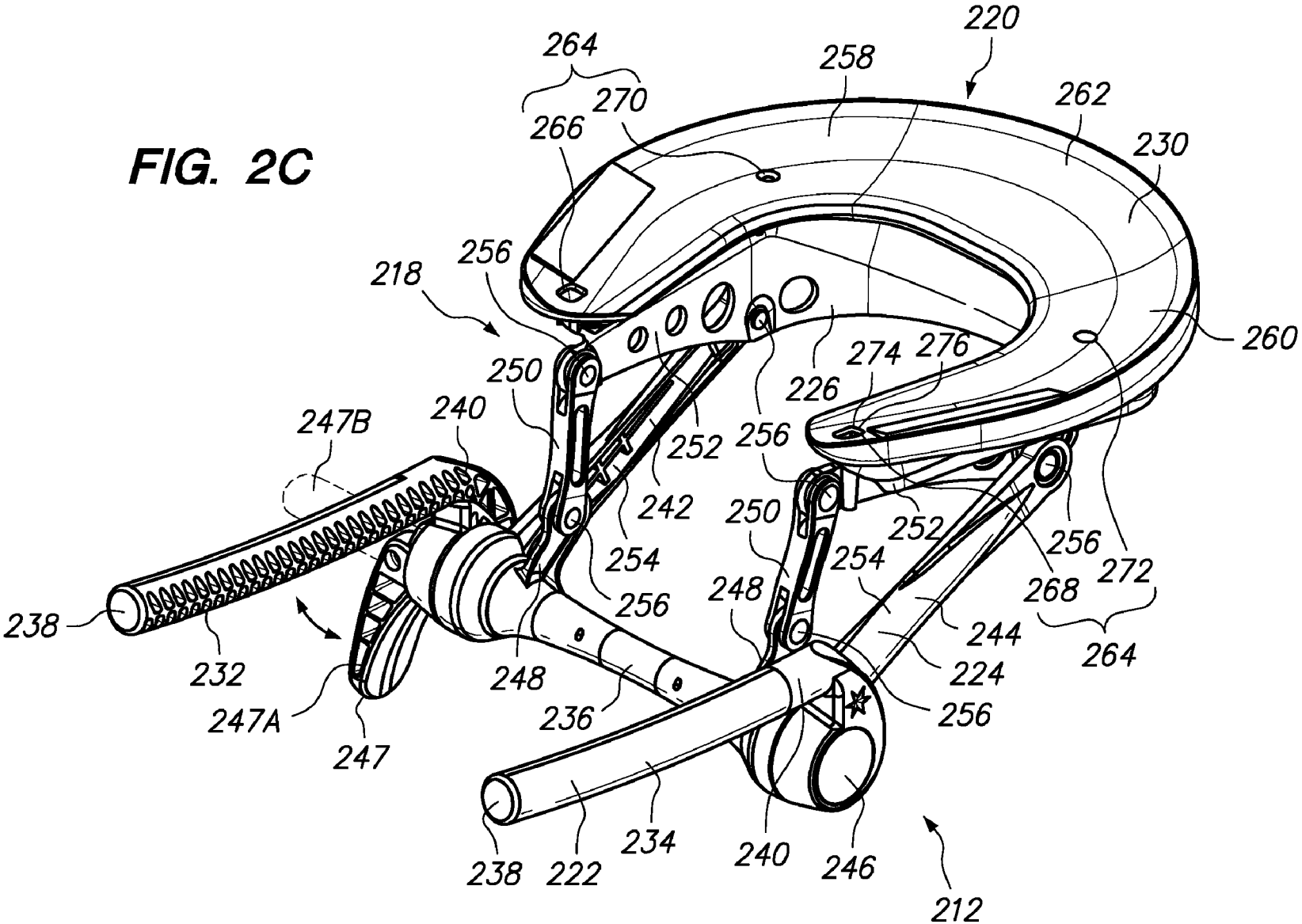
FIG. 2C is another perspective view of the headrest assembly of FIG. 2A with the headrest assembly in a higher position.
Figure 2D:
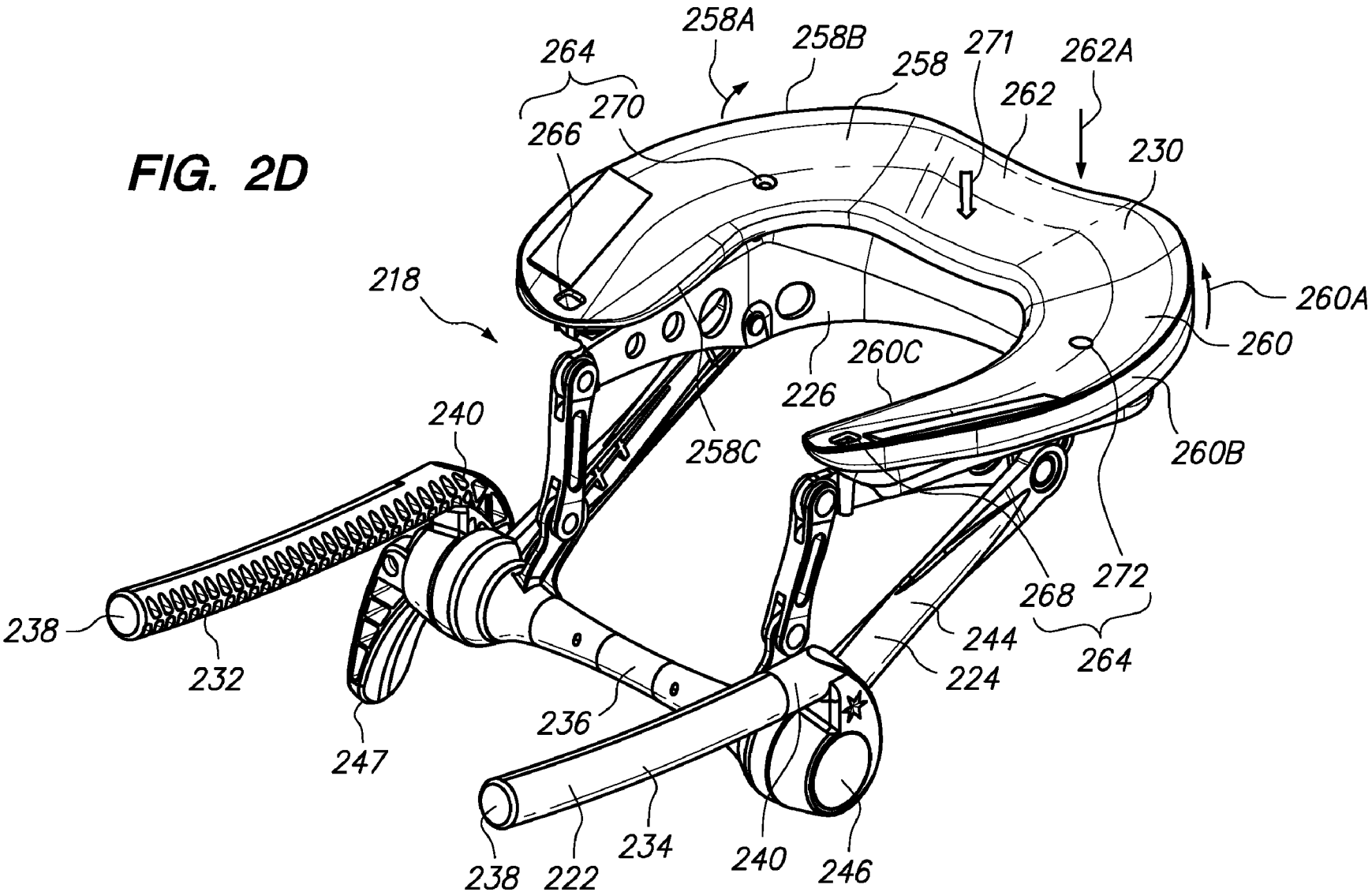
FIG. 2D is another perspective view of the headrest assembly of FIG. 2A with a load being applied to the headrest assembly.

FIG. 2A shows the headrest assembly 212 with the support arms 232, 234 in a folded configuration for storage purposes. FIG. 2B shows the headrest assembly 212 in a lower position with the support arms 232, 234 extended for coupling the headrest assembly 212 to the massage device 11 (illustrated in FIG. 1). FIG. 2C shows the headrest assembly 212 in a higher position with the support arms 232, 234 extended for coupling the headrest assembly 212 to the massage device 11. FIG. 2D shows the headrest assembly 212 with the support arms 232, 234 extended for coupling the headrest assembly 212 to the massage device 11, and with a load applied to the resilient assembly 220.

Referring back to FIG. 1, a portion of each support arm 232, 234 (only one support arm is visible in FIG. 1) of the support arm assembly 22 extends into a corresponding headrest receiver 15A in the table base 14 of the massage device 11 to facilitate selective attachment and detachment of the headrest assembly 12 to the massage device 11. In one embodiment, the support arms 232, 234 are spaced apart approximately eight inches and the headrest receivers 15A are spaced apart approximately eight inches. Alternatively, the spacing between the support arms 232, 234 and the headrest receivers 15A can be greater than or less than eight inches. Still alternatively, the support arms 232, 234 could be secured to the massage device 11 in another fashion.

Further, the amount in which the support arms 232, 234 extend into the table base 14 can be moved to adjust the position of the headrest assembly 12 relative to the table base 14. With this design, the headrest assembly 12 can be moved relative to the table base 14 to suit the needs of the patient being massaged.

The design, shape and length of each support arm 232, 234 can be varied depending upon the design requirements of the massage device assembly 10. In one embodiment, each support arm 232, 234 (i) is a rigid, generally tubular shaped beam, (ii) includes an arm first end 238 that is inserted into the headrest receiver 15A and an arm second end 240 that is positioned adjacent to an outer face 17A of the front wall 17 when the support arms 232, 234 are fully inserted into the headrest receiver 15A, and (iii) is slightly curved (somewhat arch shaped), somewhat like a Japanese sword. The purpose of the support arms 232, 234 is to hang the headrest assembly 212 outboard from the massage device 11.

As noted above, in the embodiment illustrated in FIG. 1, each headrest receiver 15A is designed to be a generally straight, right cylindrical shaped aperture that extends through the front wall 16 of the massage device 11. With the curved design of the support arms 232, 234, each support arm 232, 234 is designed to fit snugly within the corresponding, headrest receiver 15A regardless of how far the support arms 232, 234 are inserted into the headrest receivers 15A.

When each support arm 232, 234 is fully inserted into the headrest receiver 15A, the arm first end 238 moves upward and contacts the support board 16 of the massage device 11. The contact between the arm first end 238 of the support arm 232, 234 and the support board 16 further increases the snugness of the fit between the support arms 232, 234 and the headrest receivers 15A, and inhibits the support arms 232, 234 from wiggling and drooping down, which occurs in straight, prior art support arms where the arm first end does not contact the support board 16. Stated another way, the curved support arms 232, 234 have multiple advantages over straight, prior art support arms, including (1) the headrest assembly 212 is tight in the headrest receivers 15A, and (2) the headrest assembly 212 is held in a higher position, instead of drooping down like the straight, prior art support arms.

Further, the curve in the support arms 232, 234 allows for looser tolerances for the support arms 232, 234 and the headrest receivers 15A while still maintaining good engagement between these components. As a result thereof, the cost for manufacturing is reduced.

The arm connector 236 couples the first support arm 232 to the second support arm 234. The arm connector 236 is substantially tubular shaped and is coupled to each support arm 232, 234 near the arm second end 240.

Referring again to FIG. 1, it can be seen that when the support arms 232, 234 are inserted in the headrest receivers 15A so that the headrest assembly 212 is coupled to the massage device 11, the arm second end 240 of each support arm 232, 234 is positioned above the level of the arm connector 236. As a result of the support arms 232, 234 being positioned above the level of the arm connector 236, when the headrest assembly 212 is coupled to the massage device 11, the arm connector 236 is positioned low and away from the chin of the user so as to increase the comfort of the user of the massage device assembly 10.

The adjuster assembly 224 supports and selectively positions the support frame 226 and the resilient assembly 220 relative to the remainder of the massage device assembly 10. As illustrated in FIGS. 2A-2D, the adjuster assembly 224 includes a first adjuster subassembly 242, a second adjuster subassembly 244, a gear assembly 246, and a latch 247. Each adjuster subassembly 242, 244 is coupled to the arm connector 236 and the support frame 226, which cooperate to maintain the adjuster subassemblies 242, 244 spaced apart from each other. Alternatively, the adjuster assembly 224 can include more than two or less than two adjuster subassemblies 242, 244.

The design of each adjuster subassembly 242, 244 can be varied depending upon the design requirements of the massage device assembly 10. The specific design of the adjuster assembly 224, as well as the design of the support arm assembly 222, enables the arm connector 232 to be positioned away from the chin of the user so as to improve the comfort of the headrest assembly 212.

Each adjuster subassembly 242, 244 is generally made from a substantially rigid plastic material. Alternatively, each adjuster subassembly 242, 244 can be made from a different substantially rigid material.

As illustrated in FIGS. 2A-2D, each adjuster subassembly 242, 244 is a four-bar linkage-type adjuster assembly that operate in parallel to adjust the height of the support frame 226 and the resilient assembly 220 relative to the massage device 11 to enable the face 13A and/or the head 13B of the user to be supported more comfortably while receiving the massage treatment. Each adjuster subassembly 242, 244 includes a first link 248 that cantilevers away from the arm connector 236, a second link 250 that is pivotably coupled to the first link 248, a third link 252 that is pivotably coupled to the second link 250 and is secured to the support frame 226, and a fourth link 254 that cantilevers away from the arm connector 236 and is pivotably coupled to the third link 252. In the embodiment illustrated in FIGS. 2A-2D, the third link 252 is integrally formed with the support frame 226. Alternatively, the third link 252 could be coupled to or secured to the support frame 226 by a different method.

The third link 252 of each adjuster subassembly 242, 244 is integrally formed with or coupled to the support frame 226 toward the end of the support frame 226 that is positioned nearer to the massage device 11 (illustrated in FIG. 1) when the headrest assembly 212 is coupled to the massage device 11. By positioning the third link 252 of each adjuster subassembly 242, 244 in this manner, the adjuster assembly 224 and the arm connector 236 can more easily be maintained away from the face 13A and chin of the user of the massage device assembly 10 so as to improve the comfort of the headrest assembly 212 for the user.

Each adjuster subassembly 242, 244 further includes a plurality of connector pins 256 that function to allow the first link 248 to pivot relative to the second link 250, to allow the second link 250 to pivot relative to the third link 252, and to allow the fourth link 254 to pivot relative to the third link 252.

It should be noted that the use of the first link 248, the second link 250, the third link 252 and the fourth link 254 is merely for purposes of convenience and can be varied. For example, any of the links of each adjuster subassembly 242, 244 can be referred to as the first link, the second link, the third link and/or the fourth link.

The gear assembly 246 is coupled to the first adjuster subassembly 242, the second adjuster subassembly 244, and the support arm assembly 222. The gear assembly 246 functions to selectively lock the first adjuster subassembly 242, the second adjuster subassembly 244, and the support arm assembly 222 in any desired configuration so as to prevent movement of the adjuster subassemblies 242, 244 and the support arms 232, 234 relative to the rest of the headrest assembly 212.

Again referring to FIG. 1, it can be seen that when the support arms 232, 234 are inserted in the headrest receivers 15A so that the headrest assembly 212 is coupled to the massage device 11, the arm second end 240 of each support arm 232, 234 is positioned substantially directly above the gear assembly 246.

As illustrated in FIGS. 2A-2D, the latch 247 is coupled to the gear assembly 246 so as to enable the gear assembly 246 to selectively lock the positioning of the adjuster subassemblies 242, 244 and the support arms 232, 234 relative to the rest of the headrest assembly 212. As shown, the latch 247 is a standard flip-handle latch. Alternatively, another type of latching or locking mechanism can be used.

The latch 247 is selectively movable between a locked position 247A and an unlocked position 247B (illustrated in phantom), wherein when the latch 247 is in the unlocked position 247B the gear assembly 246 allows the adjuster subassemblies 242, 244 and the support arms 232, 234 to move relative to the rest of the headrest assembly 212, and wherein when the latch 247 is in the locked position 247A the gear assembly 246 prevents the adjuster subassemblies 242, 244 and the support arms 232, 234 from moving relative to the rest of the headrest assembly 212.

By selectively moving the latch 247 between the locked position 247A and the unlocked position 247B, the headrest assembly 212 can selectively be moved between the folded configuration, as illustrated in FIG. 2A; the lower position with the support arms 232, 234 ready to be inserted into the headrest receivers 15A, as illustrated in FIG. 2B; and the higher position with the resilient assembly 220 elevated and the support arms 232, 234 ready to be inserted into the headrest receivers 15A, as illustrated in FIG. 2C. It should be noted that the specific configurations and positions illustrated in FIGS. 2A-2C are for demonstration purposes only and they are not the only possible configurations and positions for the headrest assembly 212 as disclosed in the present invention. For example, the support arms 232, 234 can be positioned at a different angle relative to the rest of the headrest assembly 212 so that the resilient assembly 220 is positioned at any desired angle of tilt relative to the massage device 11. Additionally, the adjuster subassemblies 242, 244 can be adjusted so that the height of the resilient assembly 220 is positioned anywhere along the continuum between a lowest position and a highest position relative to the massage device 11. The specific configurations and positions chosen for the headrest are adapted to suit the comfort and support requirements of the person receiving the massage treatment.

The support frame 226 supports the resilient assembly 220 relative to the remainder of the frame assembly 218. As illustrated in FIGS. 2A-2D, the support frame 226 is integrally formed with the third link 252 of each adjuster subassembly 242, 244. Alternatively, the third link 252 can be coupled to or otherwise secured to the support frame 226 by a different method. The support frame 226 is typically made of a relatively light weight, rigid, plastic material. Alternatively, the support frame 226 can be made of other substantially rigid materials.

Referring back to FIG. 1, the support frame 26 includes a headrest support section 26A that is coupled to and supports the resilient assembly 20, and a flex stop section 26B that provides a limit for how much the headrest platform 30 can flex downward (illustrated by arrow 30A) when a load is applied. Stated another way, when the user of the massage device assembly 10 places their face 13A and/or their head 13B within the headrest platform 30, the headrest platform 30 will deflect only as far as the flex stop section 26B, which provides a rigid stopping point for the deflection of the headrest platform 30.

In the embodiment illustrated in the Figures, the third link 252 of each adjuster subassembly 242, 244 (illustrated in FIGS. 2A-2D) is integrally formed with or coupled to the headrest support section 26A of the support frame 26. The headrest support section 26A is positioned nearer to the massage device 11 (illustrated in FIG. 1) when the headrest assembly 12 is coupled to the massage device 11. By coupling the third link 252 of each adjuster subassembly 242, 244 to the headrest support section 26A of the support frame 26, the adjuster assembly 24 and the arm connector 236 (illustrated in FIGS. 2A-2D) can more easily be maintained away from the face 13A and chin of the user of the massage device assembly 10 so as to improve the comfort of the headrest assembly 12 for the user.

As shown in FIGS. 2A-2D, the resilient assembly 220 includes a headrest platform 230 that is substantially flat and horseshoe shaped. The horseshoe configuration is designed to comfortably receive the face 13A and/or head 13B of the user. The headrest platform 230 is conforming, lightweight and relatively inexpensive to manufacture. The headrest platform 230 can be made with a flexible plastic or another suitable material. The flat horseshoe shape has an initial rim, but it will curve into a cylindrical/spherical shape when a load is applied, such as the weight of the head of the user.

In certain embodiments, the headrest platform 230 includes a first side section 258 having a first outer edge 258B that rotates as illustrated by arrow 258A (illustrated in FIG. 2D) when pressure 271 (illustrated as an arrow) is applied to the headrest platform 230, a second side section 260 having a second outer edge 260B that rotates as illustrated by arrow 260A (illustrated in FIG. 2D) when pressure 271 is applied to the headrest platform 230, a middle section 262 that is positioned substantially between and is coupled to the first side section 258 and the second side section 260, and a hinge assembly 264 that couples the headrest platform 230 to the headrest support section 226A of the support frame 226. When the face of the user is positioned within the headrest platform 230, the side sections 258, 260 are designed to support the cheeks of the user, while the middle section is designed to support the forehead of the user.

The first side section 258 and the second side section 260 can each be made with a substantially rigid, plastic material. The middle section 262 can be made with a softer, flexible plastic or rubber material. Thus, in these embodiments, the middle section 262 is more flexible than the side sections 258, 260. Alternatively, the side sections 258, 260 can be made with a different, substantially rigid (or partly flexible) material and the middle section 262 can be made with a different flexible material. Still alternatively, the side sections 258, 260 and the middle section 262 can be made of the same or similar materials.

The headrest platform 230 is supported on the surface with the hinge assembly 264 that allows the middle section 262 to flex substantially downward as illustrated by arrow 262A (illustrated in FIG. 2D) when weight is applied. Additionally, the inside edge of the horseshoe shape of the headrest platform 230 may also be designed to flex when a load is applied.

Further, when a load 271 is applied to the headrest platform 230 and the middle section 262 flexes downward (as illustrated by the arrow 262A in FIG. 2D), such as when the headrest platform 230 is supporting the head of the user, the hinge assembly 264 allows the side sections 258, 260 to pivot (as illustrated by arrows 258A and 260A in FIG. 2D) relative to the hinge assembly 264. More particularly, when a load is applied to the headrest platform 230 and the middle section 262 flexes downward, the hinge assembly 264 allows the outer edges 258B, 260B of each side section 258, 260 to pivot upward and inward toward each other. At the same time, an inner edge 258C, 260C of each side section 258, 260 moves downward when a load is applied to the headrest platform 230. FIG. 2D illustrates the resulting movement of the middle section 262 and the side sections 258, 260 when a load, such as the weight of the head of the user, is applied.

In order for the headrest platform 230 to move smoothly, access space needs to be provided for a smooth action. When the load is removed from the headrest platform 230, the headrest platform 230 will elastically recover from all the deformation.

FIGS. 2A-2C illustrate different configurations or positions of the headrest platform 230 prior to a load being applied. For example, as noted above, FIG. 2A shows the headrest assembly 212 with the support arms 232, 234 in a folded configuration for storage purposes. FIG. 2B shows the headrest assembly 212 in a lower position with the support arms 232, 234 extended for coupling the headrest assembly 212 to the massage device 11 (illustrated in FIG. 1). FIG. 2C shows the headrest assembly 212 in a higher position with the support arms 232, 234 extended for coupling the headrest assembly 212 to the massage device 11.

FIG. 2D illustrates another perspective view of the headrest assembly 212 with a load 271 being applied, in order to demonstrate the movement of the headrest platform 230. When a load 271 is applied to the headrest platform 230, the middle section 262, which is made of a softer, rubber material, flexes downward (as illustrated by arrow 262A), while the side sections 258, 260, which are made of a rigid, plastic material, pivot relative to the hinge assembly (as illustrated by arrows 258A, 260A, respectively). As noted above, when a load is applied to the headrest assembly 212, the hinge assembly allows the outer edge 258B, 260B of each side section 258, 260 to pivot upward and inward toward each other. Stated another way, as the weight of the head is applied to the headrest platform 230 it primarily presses down on the middle section 262, and the hinge assembly 264 enables the headrest platform 230 to respond to the individual weight and shape of the head by "wrapping", "enveloping" and/or "cradling" the face and/or the head of the user.

As illustrated in the Figures, the hinge assembly 264 includes a first front pivot 266 that is positioned near the end of the first side section 258 away from the middle section 262, a second front pivot 268 that is positioned near the end of the second side section 260 away from the middle section 262, a first side pivot 270 that is positioned along the first side section 258 near the middle section 262, and a second side pivot 272 that is positioned along the second side section 260 near the middle section 262.

The front pivots 266, 268, each include an elongated front pivot hole 274 that is secured to the respective side section 258, 260, and a vertical pin 276 that is secured to the flexible headrest platform 230. With this design, the vertical pin 276 allows the front pivot hole 274 and the respective side section 258, 260 to rotate about the vertical pin 276. This allows the side sections 258, 260 to pivot and move inward. For example, the front pivot hole 274 can have a slot shape.

The side pivots 270, 272 are essentially loose fitting screw/bolt joints that couple the headrest platform 230 to the support frame 226, while still allowing the side sections 258, 260 to pivot and move relative to each other as load is applied to the headrest platform 230. Alternative, different types of side pivots 270, 272 could be utilized to couple the headrest platform 230 to the support frame 226, while still allowing the side sections 258, 260 to pivot and move relative to each other as load is applied to the headrest platform 230.

In one embodiment, the axes of the side sections 258, 260 are angled relative to the bisection plane down the median at an angle of 5.4 degrees when there is no load on the headrest platform 230. This angle is based on the biometric information that most faces are widest at the cheek bone just below the eye socket. The cheek bone is where the jaw muscle hangs. The width of the jaw is narrower as we move lower.

The axes of the side sections 258, 260 start at a 5.4 degree angle from the bisection plane, and when load is applied to the flexible middle section 262, the rubber material of the middle section 262 curves down to hug the forehead of the user. The curve consumes more material and pulls the two hinged side sections 258, 260 toward the center and toward each other. The axes of the front pivots 266, 268 gradually move toward parallel and end with a 4.3 degree angle relative to the bisection plane.

The moving axis is evident in the design of the front pivots 266, 268. The front pivot hole 274 in each of the front pivots 266, 268 is elongated to allow it to rotate about the vertical pin 276 and also move laterally within the front pivot 266, 268 toward the bisection plane. A sliding hinge is a rate design in mechanical components. To make this happen, there has be low friction material so the front pivot hole 274 can slide around the vertical pin 276. This sliding action relieves the tension in the rubber material of the middle section 262 (called hoop stress) so that the rubber material is experiencing mostly bending. If the friction is high, or the front pivot hole 274 cannot slide easily relative to the vertical pin 276, then the length of rubber is not sufficient when going from flat to cylindrical. This can be observed as a higher stiffness of the middle section 262. It can also stiffen the flexing behavior when the middle section 262 experiences shrinkage during cooling (either in use or during the molding process).

The rigid side sections 258, 260, which support the cheeks of the user, are hinged at an axis with an angle of 3 to 8 degrees to the bisection plane of the face. This hinge angle has to change to allow the maximum flex performance of the middle section 262. Depending on the load and the curvature of the middle section 262, this angle can be reduced by 1 to 2 degrees. The angle may be small, but it has a strong influence to the changing shape of the headrest platform 230.

Additionally, as noted in FIG. 2B, the flexible headrest platform 230 can include one or more portions of a hook and loop type fastener 281 that assist in securing the resilient member 28 to the headrest platform 230.

Figure 3A:
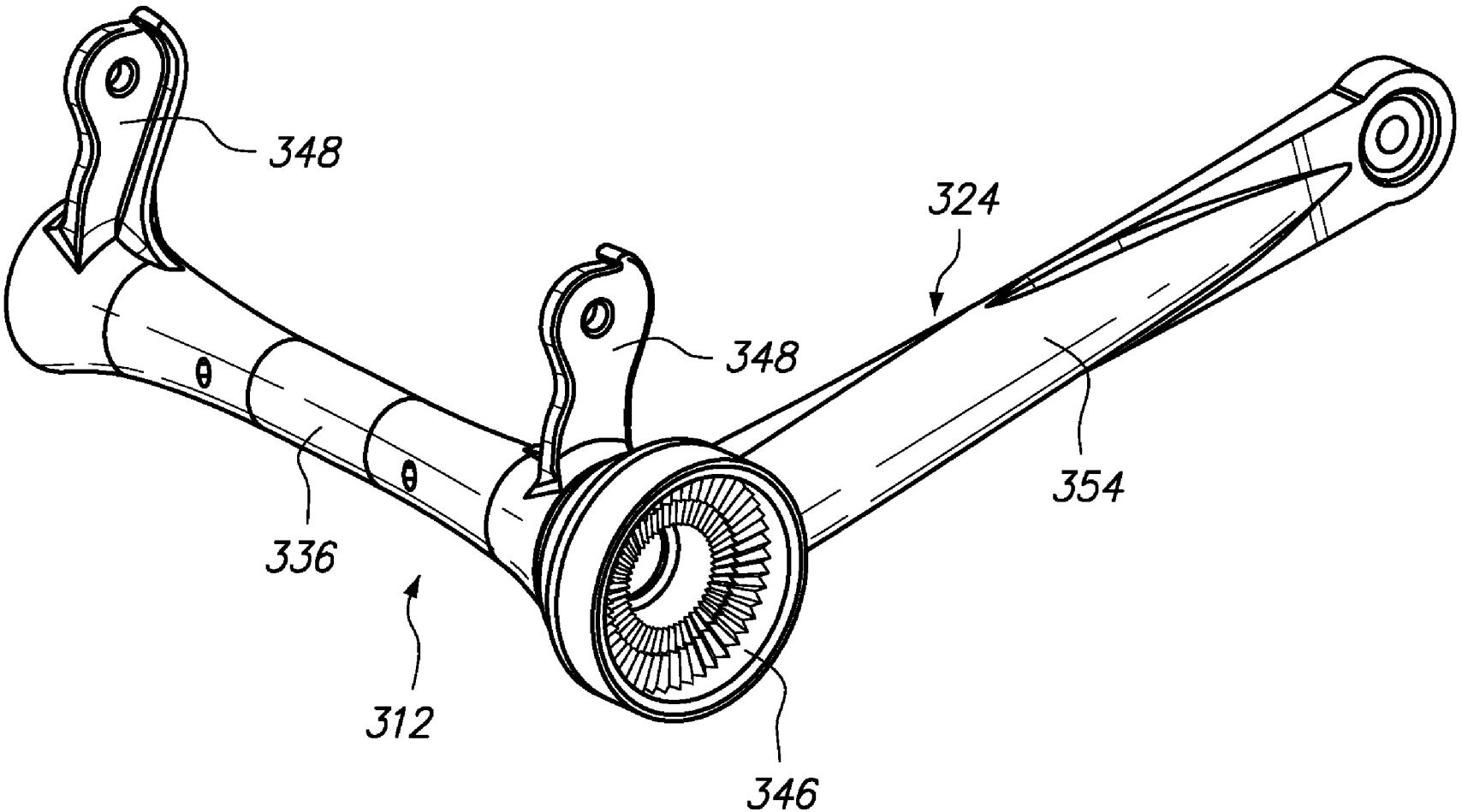
FIG. 3A is a perspective view of a portion of the headrest assembly.
Figure 3B:
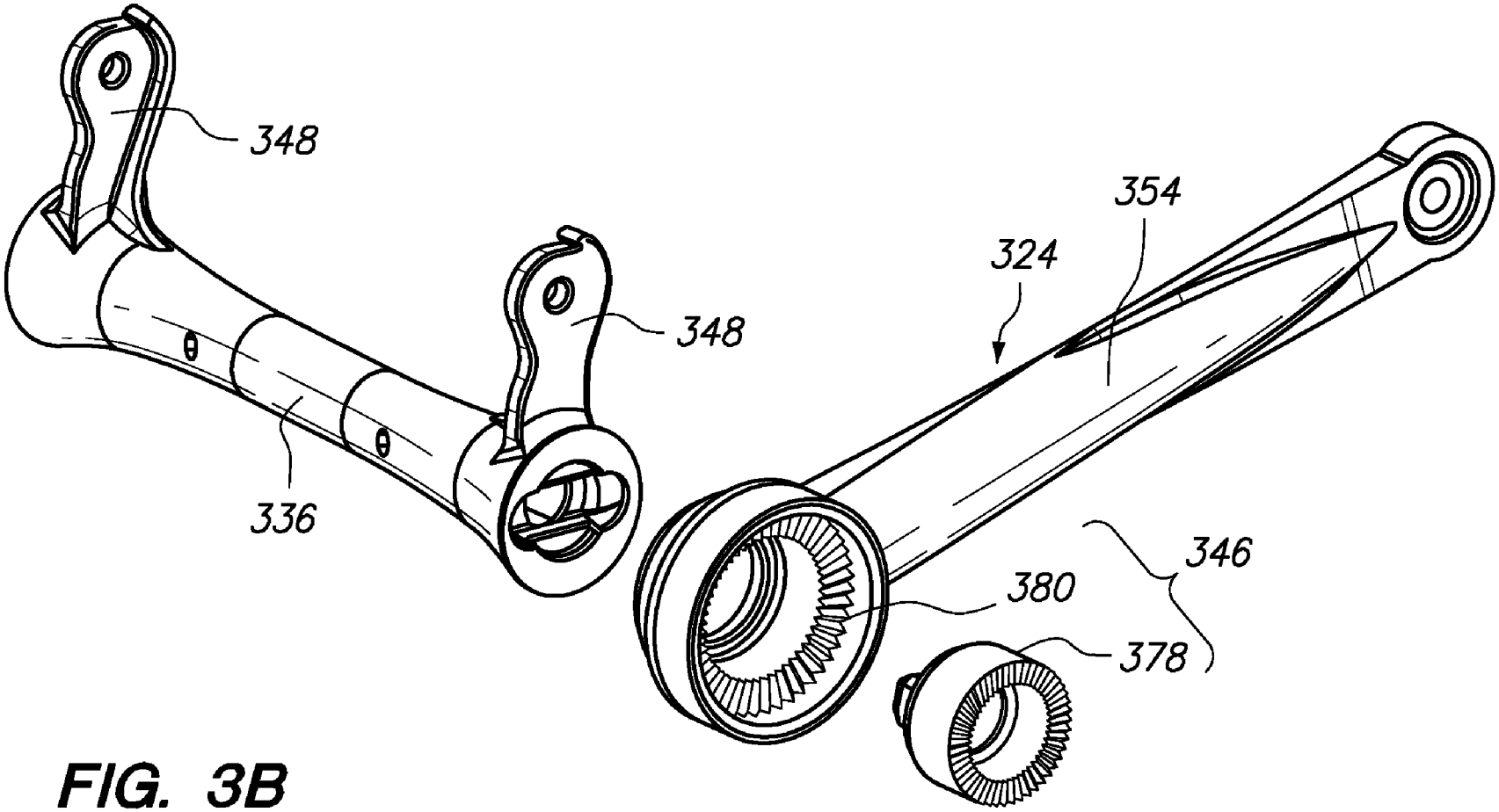
FIG. 3B is an exploded perspective view of the portion of the headrest assembly.

FIGS. 3A and 3B illustrate a perspective view and an exploded perspective view of a portion of the headrest assembly 312. More particularly, FIGS. 3A and 3B illustrate a portion of the gear assembly 346, the arm connector 336, and the first link 348 and the fourth link 354 of the adjuster assembly 324.

The gear assembly 346 is designed to selectively lock the positioning and configuration of the support arm assembly 222 (illustrated in FIGS. 2A-2D) and the adjuster assembly 324. As shown in FIGS. 3A and 3B, the gear assembly 346 includes a small crown gear 378 and a large crown gear 380. In one embodiment, the first link 348 of the adjuster assembly 324 is coupled to the arm connector 336, and the fourth link 354 of the adjuster assembly 324 is coupled to the large crown gear 380. The small crown gear 378 and the large crown gear 380 are designed to be concentric with each other so that the first link 348 and the fourth link 354 are locked at the same time. It should be noted that although FIGS. 3A and 3B only show the concentric gears 378, 380 on the right side of the headrest assembly 312, there is also another set of concentric gears on the left side of the headrest assembly 312.

When the massage therapist adjusts the height of the headrest platform 230 (illustrated in FIGS. 2A-2D), any left or right lean is not wanted. With the specific design of the adjuster assembly 324, the first links 348 are always moving up and down together so that it is not possible to have one short arm high and the other short arm lower.

Figure 4:
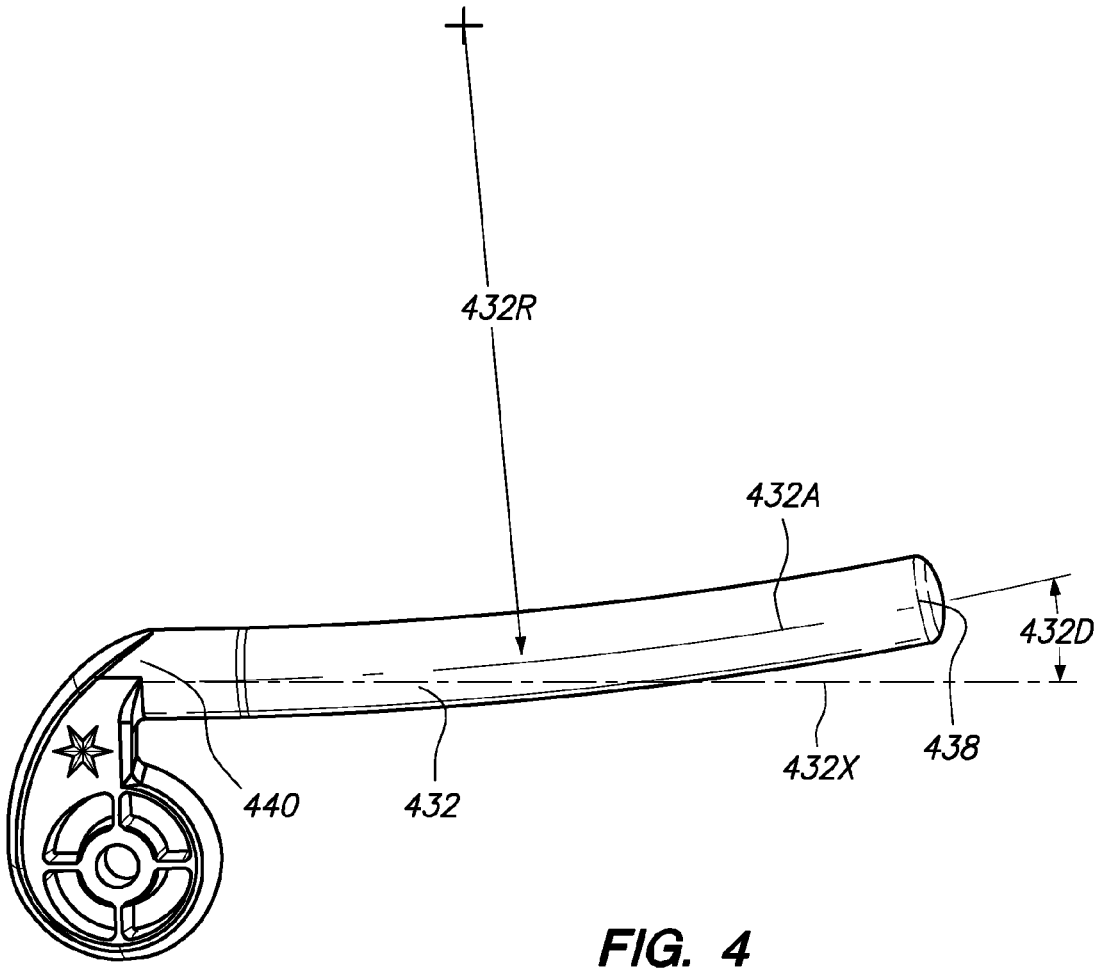
FIG. 4A is a side view of a support arm having features of the present invention.

FIG. 4 is a side view of a support arm 432 having features of the present invention. In certain embodiments, the support arms are 0.75 inch diameter and about 7 inches long. FIG. 4 also includes a straight line axis 432X as a basis of comparison to prior art straight support arms. Additionally, an arc of curvature 432A that extends along the length of the support arm 432 from the arm first end 438 to the arm second end 440, a radius of curvature 432R and an angle of curvature 432D are also included in FIG. 4 to demonstrate the degree of actual curvature of the support arm 432 of the present invention. The actual arc of curvature 432A, actual radius of curvature 432R and actual angle of curvature 432D are exaggerated for purposes of illustration. In certain embodiments, the radius of curvature 432R is designed to be approximately thirty-six inches. Alternatively, the radius of curvature 432R can be designed to be less than or greater than thirty-six inches.

As noted above and as best shown by referring back to FIG. 1, the arm first end 438 is adapted to extend into the massage device 11. When the support arm 432 is coupled to the massage device 11, the gear assembly 246 (illustrated in FIGS. 2A-2D) is positioned below and spaced apart from the arc of curvature 432A. With the curved design of the present invention, the arm first end 438 of the support arm 432 starts to move upward and contact the support board 16 of the massage device 11 when the support arm 432 is fully engaged with the massage device 11 so that the support arm 432 is wedged tight into the massage device 11. The contact between the arm first end 438 of the support arm 432 and the support board 16 makes the fit snug so that there is less movement and the position of the headrest assembly is pushed higher with less droop or sagging. The prior art straight support arm will wiggle and droop down because the end of the support arm does not contact the support board.

Also, the design of the support arm 432 of the present invention, where the arm connector 236 is positioned below the arm second end 440 of the support arm 432 and below and spaced apart from the arc of curvature 432A of the support arm 432 when the support arm 432 is coupled to the massage device 11, enables the arm connector 236 to be positioned away from the chin of the user. The arm connector for the prior art straight support arm is higher and more to the left, which leads the arm connector to come closer to the proximity of the chin.

Figure 5:
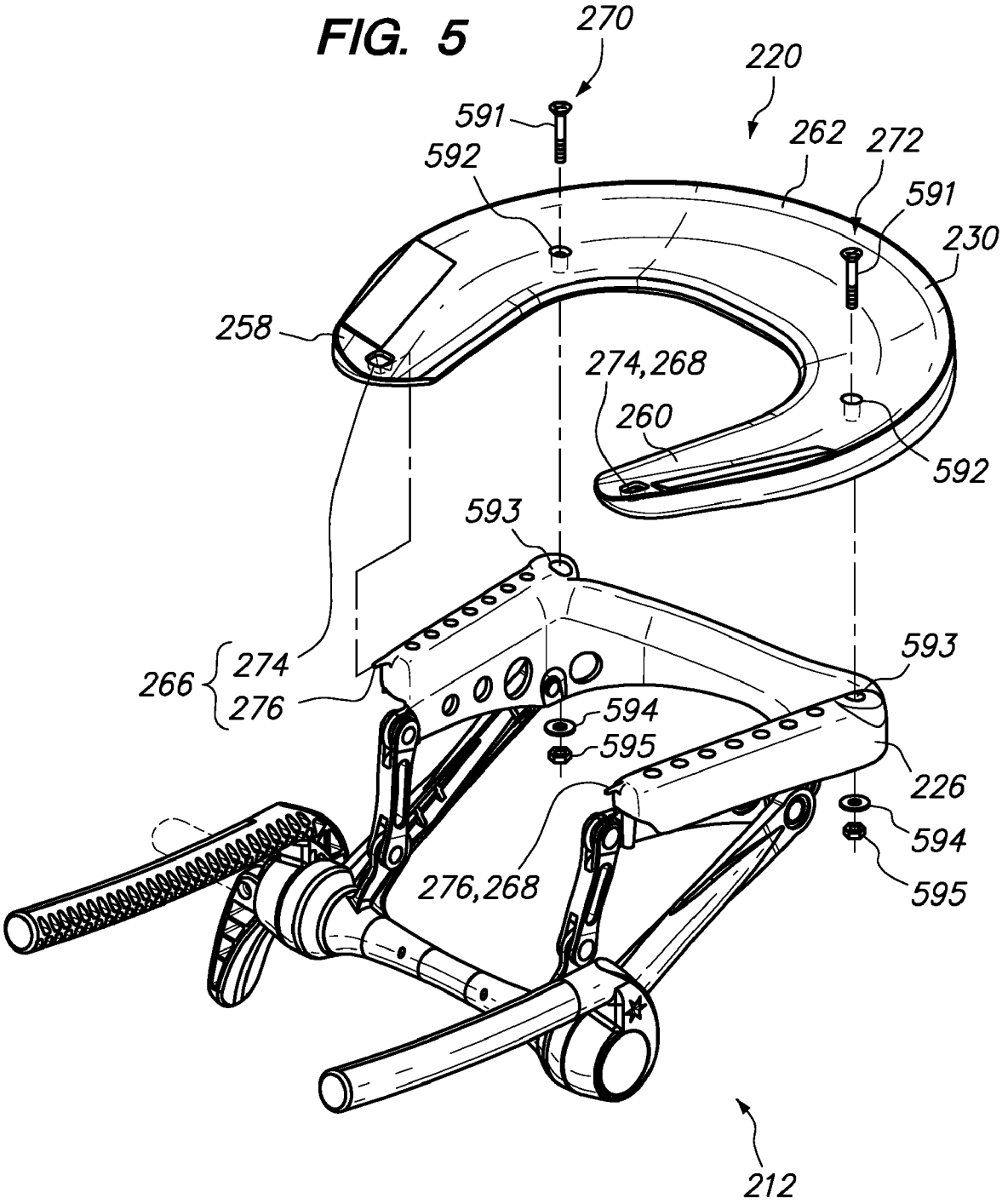
FIG. 5 is a partly exploded view of a portion of the headrest assembly.

FIG. 5 is a partly exploded view of a portion of the headrest assembly 212 with the headrest platform 230 of the resilient assembly 220 positioned away from the support frame 226. The middle section 262 and the side sections 258, 260 are also noted in FIG. 5.

Further, FIG. 5 illustrates the side pivots 270, 272 in more detail. In particular, in one embodiment, each side pivot 270, 272 includes (i) a threaded screw 591 that extends through a tubular shaped aperture 592 in the headrest platform 230, and a slot shaped opening 593 in the support frame 226, (ii) a washer 594 that fits over the screw 591 near the support frame 226, and (iii) a nut 595 that is threaded onto the screw 591 to loosely secure the headrest platform 230 to the support frame 226. It should be noted that the slot shaped opening 593 allows the middle section 262 to move downward and the side sections 258, 260 to pivot.

Moreover, FIG. 5 also illustrate the front pivot hole 274 in the respective side section 258, 260 and the vertical pins 276 (illustrated in phantom) that are part of and secured to the respective side section 258, 260. With this design, the vertical pin 276 allows the front pivot hole 274 and the respective side section 258, 260 to rotate about the vertical pin 276.

Figure 6A:
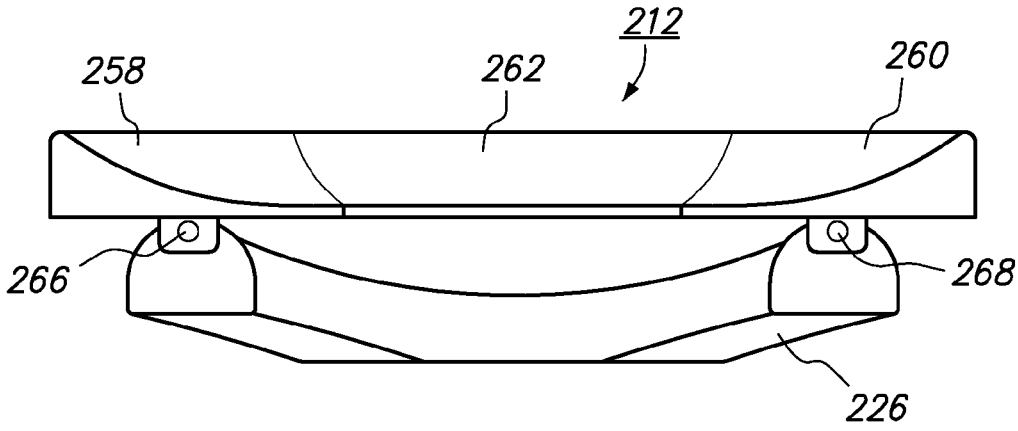
FIG. 6A is a simplified rear end view of a portion of the headrest assembly.
Figure 6B:
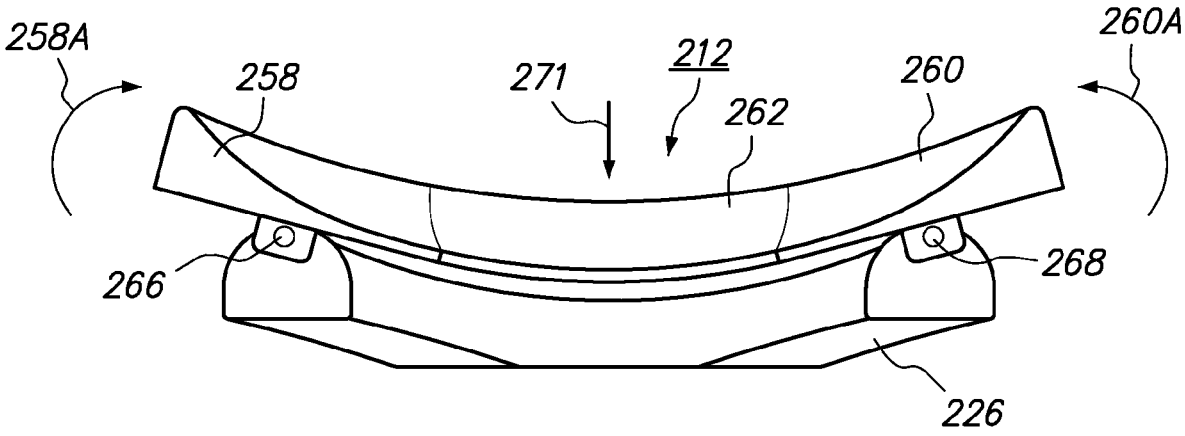
FIG. 6B is a simplified rear end view of the portion of the headrest assembly deflected.

FIG. 6A is a simplified rear end view of a portion of the headrest assembly 212, and FIG. 6B is a simplified rear end view of the portion of the headrest assembly partly deflected. These Figures illustrate the middle section 262, the first side section 258, the second side section 260, and the front pivots 266, 268.

In this embodiment, comparing FIGS. 6A and 6B illustrate how the middle section 262 moves downward and the side sections 258, 260 pivot as illustrated by arrows 258A, 260A when force is applied (as illustrated by arrow 271).

Figure 7A:
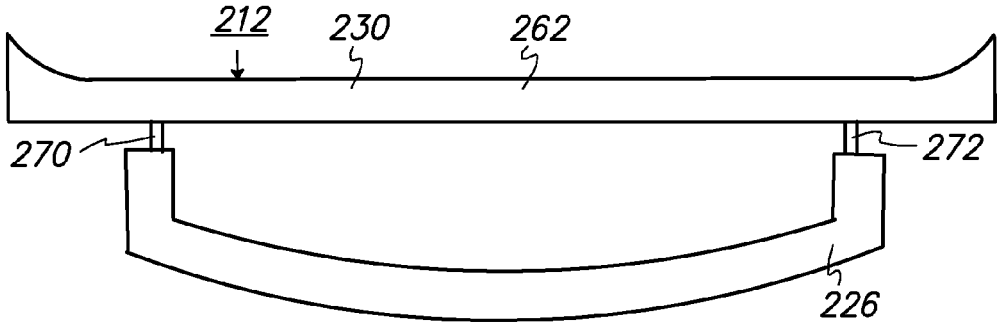
FIG. 7A is a further simplified front end view of a portion of the headrest assembly.
Figure 7B:
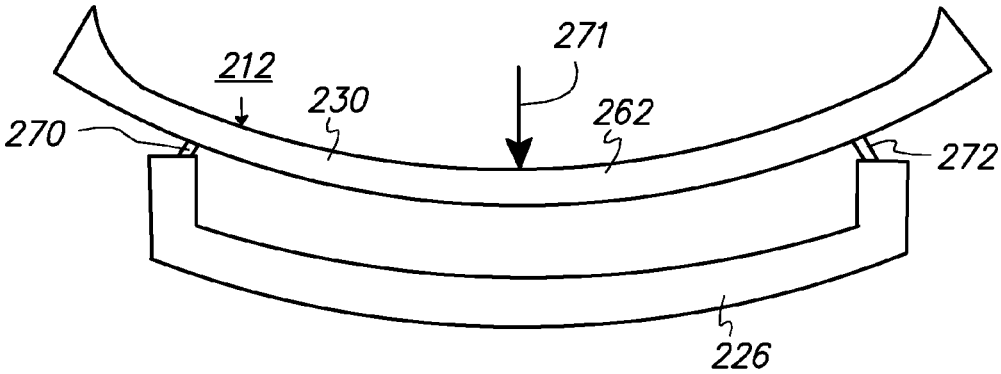
FIG. 7B is a further simplified front end view of the portion of the headrest assembly deflected.

FIG. 7A is a simplified front end view of a portion of the headrest assembly 212 and FIG. 7B is a simplified front end view of the portion of the headrest assembly 212 partly deflected. These Figures illustrate the middle section 262 of the flexible headrest platform 230, the first side pivot 270, the second side pivot 272 and the support frame 226. When the load 271 is applied to the headrest platform 230, the middle section 262, which is made of a flexible material, flexes downward (as illustrated in FIG. 7B). Comparing FIGS. 7A and 7B illustrate how the side pivots 270, 272 are allowed to pivot relative to the support frame 226. In one embodiment, the support frame 226 includes slots that allow the side pivots 20, 272 to pivot to allow the middle section 262 to move downward.

In one embodiment, the side pivots 270, 272 are essentially loose fitting screw/bolt joints that couple the headrest platform 230 to the support frame 226, while still allowing the side sections 258, 260 to pivot and move relative to each other as load is applied to the headrest platform 230. It should be noted that when the middle section 262 moves downward, the side sections (not shown in FIGS. 6A and 6B) primarily rotate, however, the portion near the middle section 262 also moves inward due to the side pivots 270, 272.

It should be noted that the movement of the middle section 262 has been exaggerated and simplified for clarity.

Figure 7C:
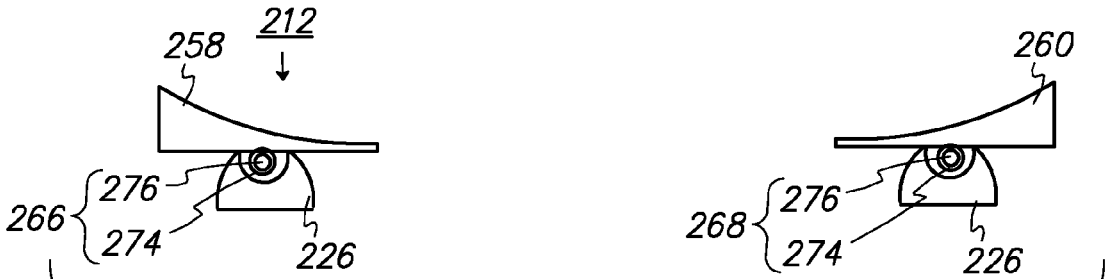
FIG. 7C is a further simplified rear end view of a portion of the headrest assembly.
Figure 7D:
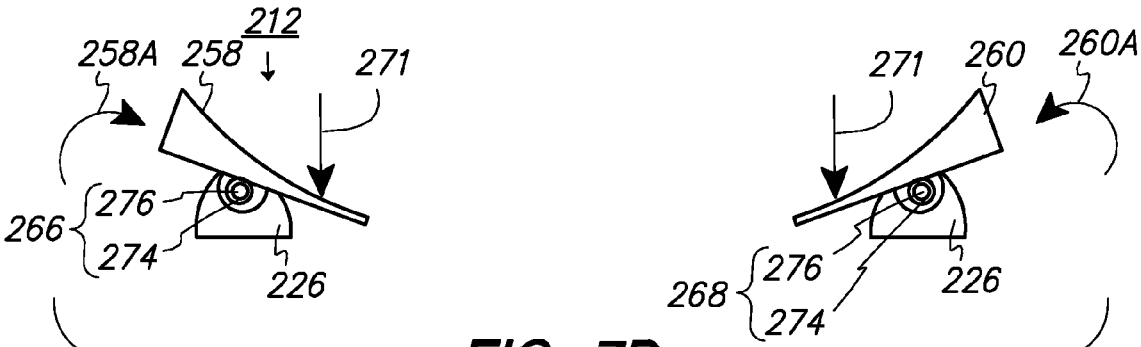
FIG. 7D is a further simplified rear end view of the portion of the headrest assembly deflected.

FIG. 7C is a simplified rear end view of a portion of the headrest assembly 212 FIG. 7D is a simplified rear end view of the portion of the headrest assembly 212 deflected. These Figures illustrate the side sections 258, 260 of the flexible headrest platform 230, the first front pivot 266, the second front pivot 268 and the support frame 226. When the load 271 is applied to the headrest platform 230, the side sections 258, 260 pivot as illustrated by arrows 258A, 260A (as illustrated in FIG. 7D). Comparing FIGS. 7C and 7D illustrate how the front pivots 266, 268 allow the side sections 258, 260 to pivot relative to the support frame 226.

It should be noted that FIGS. 7C and 7D also illustrate the front pivot hole 274 (illustrated in phantom) in the respective side section 258, 260 and the vertical pin 276 (illustrated in phantom) that is secured to the respective side section 258, 260. With this design, the vertical pin 276 allows the front pivot hole 274 and the respective side section 258, 260 to rotate about the vertical pin 276.

It should be noted that the movement of the side sections 258, 260 has been exaggerated and simplified for clarity.

While the current invention is disclosed in detail herein, it is to be understood that it is merely illustrative of the presently preferred embodiments of the invention and that no limitations are intended to the details of construction or design herein shown other than as described in the appended claims.

What is claimed is:

1. A headrest assembly for supporting a head of a user of a massage device, the headrest assembly comprising:

a frame assembly that is selectively coupled to the massage device; and a resilient assembly that is coupled to the frame assembly, the resilient assembly including an upper resilient member and a headrest platform that supports the upper resilient member, the headrest platform is continuously u-shaped having a first side section, a second side section, a middle section that is positioned substantially between and is coupled to the first side section and the second side section, and a hinge assembly that connects the side sections to the frame assembly, the hinge assembly allowing the middle section to flex substantially downward and the side sections to pivot relative to the frame assembly when the headrest platform is supporting the head of the user;

wherein the hinge assembly includes a first front pivot that is connected to the first side section and a second front pivot that is connected to the second side section; wherein the hinge assembly further includes a first side pivot that is connected to the first side section and a second side pivot that is connected to the second side section.

2. The headrest assembly of claim 1 wherein an outer edge of the first side section and an outer edge of the second side section pivot upward and inward toward each other when the headrest platform is supporting the head of the user.

3. The headrest assembly of claim 1 wherein each front pivot includes a front pivot hole and a vertical bolt, and wherein the front pivot hole is sized to allow the vertical bolt to rotate and to move laterally within the front pivot hole.

4. The headrest assembly of claim 1 wherein the frame assembly includes a support frame having a headrest support section that is coupled to and supports the resilient assembly and a flex stop section that limits how far the middle section can flex downward when downward pressure is applied on the middle section.

5. The headrest assembly of claim 1 wherein the frame assembly includes an adjuster assembly that selectively adjusts the positioning of the resilient assembly relative to the massage device.

6. The headrest assembly of claim 1 wherein the frame assembly includes a support arm assembly that selectively couples the headrest assembly to the massage device.

7. The headrest assembly of claim 1 wherein the frame assembly includes (i) a support arm assembly having a first support arm and a spaced apart second support arm that cooperate to selectively couple the headrest assembly to the massage device; and (ii) an adjuster assembly having a first adjuster subassembly, a spaced apart second adjuster subassembly, and a gear assembly, wherein the first adjuster subassembly and the second adjuster subassembly cooperate to selectively adjust the positioning of the resilient assembly relative to the massage device, and wherein the gear assembly selectively locks the positioning of the first support arm, the second support arm, the first adjuster subassembly and the second adjuster subassembly.

8. The headrest assembly of claim 7 wherein each of the support arms includes a first end, a second end, an arc of curvature that extends from the first end to the second end, and an arm connector that couples the support arms together, and wherein the arm connector is positioned below and spaced apart from the arc of curvature when the headrest assembly is coupled to the massage device.

9. The headrest assembly of claim 1 wherein the first side section and the second side section are made from a substantially rigid, plastic material.

10. The headrest assembly of claim 1 wherein the middle section is made from a flexible, rubber material.

11. A massage device assembly including a massage device that supports a body of the user during a massage treatment, and the headrest assembly of claim 1, wherein the frame assembly includes a support arm assembly that selectively couples the headrest assembly to the massage device.

12. A headrest assembly for use with a massage device having a support board, a front wall, a first receiver aperture that extends through the front wall and a spaced apart second receiver aperture that extends through the front wall, the headrest assembly supporting a head of a user during a massage treatment, the headrest assembly comprising:

a resilient assembly that supports the head of the user; and a support arm assembly that couples the resilient assembly to the massage device, the support arm assembly having a first support arm and a spaced apart second support arm that are adapted to extend through the first receiver aperture and the second receiver aperture, respectively, the first support arm being curved to inhibit the first support arm from moving relative to the first receiver aperture when the headrest platform is supporting the head of the user.

13. The headrest assembly of claim 12 wherein the second support arm is curved to inhibit the second support arm from moving relative to the second receiver aperture when the headrest platform is supporting the head of the user, wherein each support arm includes an arm first end and an arm second end, and wherein the arm first end contacts a bottom side of the support board when the support arms are coupled to the massage device.

14. The headrest assembly of claim 12 wherein the support arm assembly further includes an arm connector that couples the first support arm to the second support arm.

15. The headrest assembly of claim 14 wherein the second arm end of each support arm is positioned above the level of the arm connector when the support arms are coupled to the massage device.

16. The headrest assembly of claim 12 further including an adjuster assembly that selectively adjusts the positioning of the resilient assembly relative to the massage device.

17. The headrest assembly of claim 12 further comprising a frame assembly that is selectively coupled to the massage device, wherein the resilient assembly includes an upper resilient member and a headrest platform that supports the upper resilient member, the headrest platform having a first side section, a second side section, a middle section that is positioned substantially between and is coupled to the first side section and the second side section, and a hinge assembly that connects the side sections to the frame assembly, the hinge assembly allowing the middle section to flex substantially downward and the side sections to pivot relative to the frame assembly when the headrest platform is supporting the head of the user.

18. The headrest assembly of claim 17 wherein the frame assembly includes a support frame having a headrest support section that is coupled to and supports the resilient assembly and a flex stop section that limits how far the middle section can flex downward when downward pressure is applied on the middle section.

19. A massage device assembly including a massage device that supports a body of the user during a massage treatment, and the headrest assembly of claim 12, wherein the support arm assembly selectively couples the headrest assembly to the massage device.

20. A headrest assembly for use with a massage device having a support board, a front wall, a first receiver aperture that extends through the front wall and a spaced apart second receiver aperture that extends through the front wall, the headrest assembly supporting a head of a user during a massage treatment, the headrest assembly comprising:

a resilient assembly that supports the head of the user; and a support arm assembly that couples the resilient assembly to the massage device, the support arm assembly having a first support arm and a spaced apart second support arm that are adapted to extend through the first receiver aperture and the second receiver aperture, each support arm having an arm first end, an arm second end, an arc of curvature that extends from the arm first end to the arm second end, an arm connector that couples the support arms together, and a gear assembly that selectively locks the position of the first support arm and the second support arm, wherein the arm connector is positioned below and spaced apart from the arc of curvature when the support arms are coupled to the massage device.

21. The headrest assembly of claim 20 wherein each support arm is curved to inhibit the support arms from moving relative to the receiver apertures when the headrest platform is supporting the head of the user.

22. The headrest assembly of claim 21 wherein the arm first end contacts a bottom side of the support board when the support arms are coupled to the massage device.

23. The headrest assembly of claim 20 wherein the support arm assembly further includes an arm connector that couples the first support arm to the second support arm.

24. The headrest assembly of claim 20 further including an adjuster assembly that selectively adjusts the positioning of the resilient assembly relative to the massage device.

25. The headrest assembly of claim 20 further comprising a frame assembly that is selectively coupled to the massage device, wherein the resilient assembly includes an upper resilient member and a headrest platform that supports the upper resilient member, the headrest platform having a first side section, a second side section, a middle section that is positioned substantially between and is coupled to the first side section and the second side section, and a hinge assembly that connects the side sections to the frame assembly, the hinge assembly allowing the middle section to flex substantially downward and the side sections to pivot relative to the frame assembly when the headrest platform is supporting the head of the user.

26. The headrest assembly of claim 25 wherein the frame assembly includes a support frame having a headrest support section that is coupled to and supports the resilient assembly and a flex stop section that limits how far the middle section can flex downward when downward pressure is applied on the middle section.

27. A massage device assembly including a massage device that supports a body of the user during a massage treatment, and the headrest assembly of claim 20, wherein the support arm assembly selectively couples the headrest assembly to the massage device.

28. A method for supporting a head of a user of a massage device, the method comprising the steps of:

selectively coupling a frame assembly to the massage device; and coupling a resilient assembly to the frame assembly, the resilient assembly including an upper resilient member and a headrest platform that supports the upper resilient member, the headrest platform is continuously u-shaped having a middle section, a first side section, a second side section, and a hinge assembly that connects the side sections to the frame assembly, the hinge assembly allowing the middle section to flex substantially downward and the side sections to pivot relative to the frame assembly when the headrest platform is supporting the head of the user; wherein the step of coupling includes the hinge assembly includes a first front pivot that is connected to the first side section and a second front pivot that is connected to the second side section; wherein the step of coupling further includes the hinge assembly further includes a first side pivot that is connected to the first side section and a second side pivot that is connected to the second side section.

29. The method of claim 28 wherein the step of coupling includes an outer edge of the first side section and an outer edge of the second side section that pivot upward and inward toward each other when the headrest platform is supporting the head of the user.

30. The method of claim 28 wherein the step of coupling includes the frame assembly having a support frame including a headrest support section that is coupled to and supports the resilient assembly and a flex stop section that limits how far the middle section can flex downward when downward pressure is applied on the middle section.

31. The method of claim 28 wherein the step of coupling includes the frame assembly having (i) a support arm assembly including a first support arm and a spaced apart second support arm that cooperate to selectively couple the headrest assembly to the massage device; and (ii) an adjuster assembly having a first adjuster subassembly, a spaced apart second adjuster subassembly, and a gear assembly, wherein the first adjuster subassembly and the second adjuster subassembly cooperate to selectively adjust the positioning of the resilient assembly relative to the massage device, and wherein the gear assembly selectively locks the positioning of the first support arm, the second support arm, the first adjuster subassembly and the second adjuster subassembly.

32. A method for making a massage device assembly including the steps of:

providing a massage device that supports a body of the user during a massage treatment;

supporting a head of the user of the massage device with the method of claim 28, wherein the frame assembly includes a support arm assembly that selectively couples the headrest assembly to the massage device.

* * * * *